United States Patent [19]

Petree

[11] 3,991,551

[45] Nov. 16, 1976

[54] COMPOSITE YARN AND METHOD OF MAKING THE SAME

[75] Inventor: David W. Petree, High Point, N.C.

[73] Assignee: Burlington Industries, Inc., Greensboro, N.C.

[22] Filed: Jan. 9, 1969

[21] Appl. No.: 790,083

Related U.S. Application Data

[62] Division of Ser. No. 301,766, Aug. 13, 1963, abandoned.

[52] U.S. Cl. ..... 57/152; 57/140 BY; 57/163

[51] Int. Cl.[2] ..... D02G 3/32

[58] Field of Search ..... 57/152, 163, 160, 12, 57/3, 144, 140 BY, 90, 157 R

[56] References Cited

UNITED STATES PATENTS

| | | | |
|---|---|---|---|
| 2,263,614 | 11/1941 | Cote | 57/163 |
| 2,804,745 | 9/1957 | Foster | 57/152 |
| 3,009,311 | 11/1961 | Wang | 57/152 |
| 3,011,302 | 12/1961 | Rupprecht | 57/152 |
| 3,017,740 | 1/1962 | Humphreys | 57/163 |
| 3,038,295 | 6/1962 | Humphreys | 57/152 |
| 3,068,636 | 12/1962 | Masurel | 57/144 X |
| 3,069,883 | 12/1962 | Burleson et al. | 57/152 X |
| 3,166,885 | 1/1965 | Bridgeman et al. | 57/152 |
| 3,234,725 | 2/1966 | Storti | 57/163 |
| 3,365,875 | 1/1968 | Hall | 57/163 |

*Primary Examiner*—John Petrakes
*Attorney, Agent, or Firm*—Cushman, Darby & Cushman

[57] ABSTRACT

Composite yarn comprising elastomer yarn and a textured multifilament synthetic thermoplastic yarn, e.g. stretch continuous filament nylon yarn, twisted together. The composite yarn is made while the elastomer yarn is in a stretched condition and the textured yarn is extended so that crimps, loops or other distortions therein are straightened out.

9 Claims, 2 Drawing Figures

COMPOSITE YARN AND METHOD OF MAKING THE SAME

Figure 1:
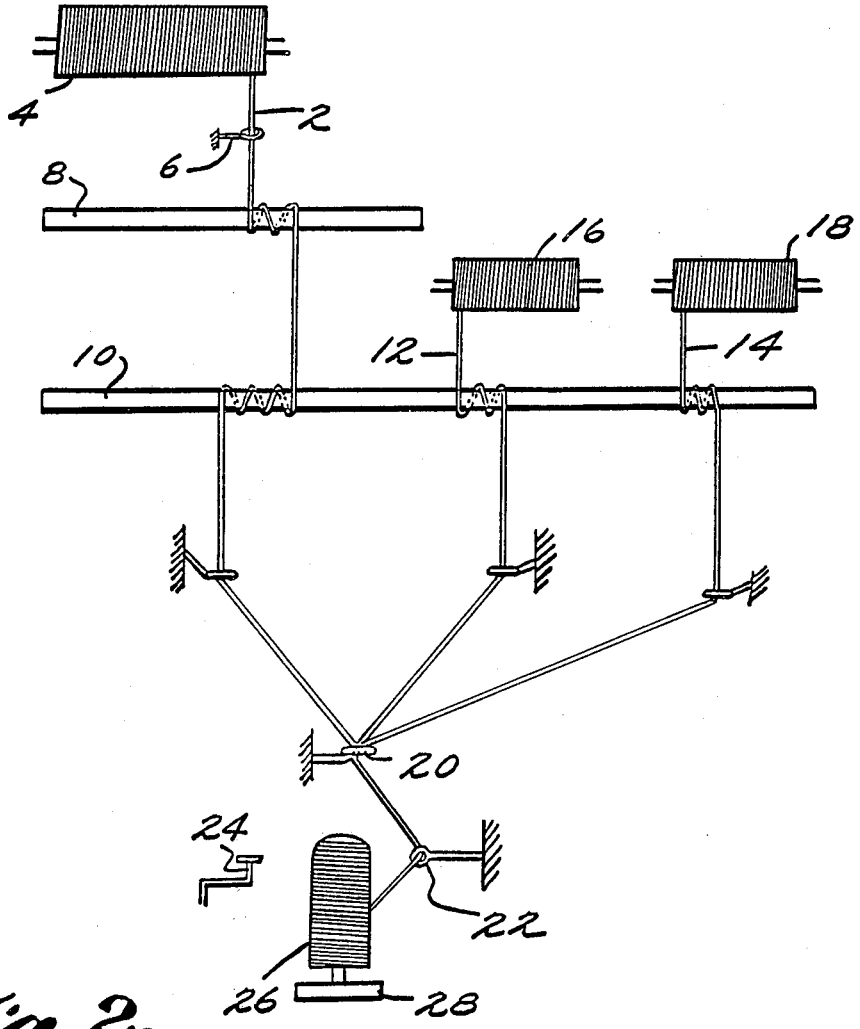

This application is a division of Ser. No. 301,766, filed Aug. 13, 1963, now abandoned.

This invention relates to a novel type of composite stretch yarn and a method of making the same.

Broadly stated, the composite yarn of the invention comprises elastomer yarn and a textured multifilament synthetic thermoplastic yarn, e.g. stretch continuous filament nylon yarn, twisted together while the elastomer yarn is in a stretched condition and the textured yarn is extended so that crimps, loops or other distortions therein are straightened out.

The elastomer yarn used herein preferably comprises a monofilament or multifilament polyurethane yarn having a denier of from about 15 to 400 in its relaxed state. This yarn is capable of stretching at least several times its original, relaxed length (e.g. five times) up to about 600 to 800 percent (i.e. seven to nine times its original relaxed length). Several suitable types of polyurethane yarns are known in the art including those available as "Lycra" and "Vyrene."

In preparing the composite yarns of the invention, it is preferred to have the polyurethane yarn elongated by 50 to 400 percent (i.e. stretched to a length which is one and one-half to five times its relaxed length) when the yarn is twisted with the stretch nylon yarn or equivalent type of textured yarn. The degree of stretch should be kept constant throughout the twisting operation and should not in any instance exceed 90 percent of the maximum elongation. Elongation of the polyurethane may be accomplished by feeding the yarn between two positive control points to insure uniformity in the final product. A ring twister, which is well known in the art, equipped with two sets of feed rolls can be effectively used to prepare the composite yarn of the invention.

As indicated, the textured yarn used herein should also be in the extended state during the twisting operation so that crimps or other distortions therein are straightened out. However, when the resulting composite yarn is relaxed, the distortions in the textured yarn return and the polyurethane contracts to give a product which is characterized by its outstanding bulk and "muscle." These properties are definitely and uniquely distinguishable from the products obtained by, for example, twisting polyurethane yarn with conventional non-stretch nylon yarn or wrapping filament or staple material about a polyurethane core. In the present case, the product is essentially a plied product in the stretched condition with the components able to contract when the yarn is relaxed. In the relaxed state, the components return essentially to their original lengths and the textured yarn loosely and substantially completely covers the elastomer yarn with sufficient association of the components to prevent separation and give a highly attractive product.

Any of the conventional textured yarns may be used herein. Preferably, the textured yarn comprises continuous multifilament stretch nylon yarn made by the well known Helanca process or false twisting techniques (e.g. Fluflon, Superloft, Agilon, Saaba, etc). Bulky nylon yarns made by crimping (Ban-Lon) or by means of an air jet (Taslan) may also be used herein. Other materials, such as polyethylene terephthalate (e.g. Dacron), which are capable of being textured, are also contemplated for use. Spun stretch yarns, rather than continuous filament yarns, may also be used.

The products of the invention may comprise one end, and preferably two or more ends, twisted together with the polyurethane or like elastomer yarn. Advantageously, the denier of the textured yarn is lower than the denier of the elastomer yarn. However, deniers in the range of 20 to 200 may be used for the textured yarn. When two or more ends of textured yarn are employed, it is usually preferred that these have the same denier although, if desired, different deniers may be used.

The amount of twist applied in forming the final product may be varied but generally should fall in the range of from 2 to 20 turns per inch. This is usually sufficient to prevent undesired looping and slipping when the composite yarn is knitted or woven under tension. The direction of this twist should be opposed to any torque or twist in the textured yarn component or components in order to balance the final product. Thus, if a stretch nylon yarn having a "Z" torque is used, the twist applied in combining this yarn with the polyurethane yarn should be in the "S" direction. When two ends of stretch nylon yarn are used, it is preferred that these have the same direction of torque or twist but if they are opposed, the degree of twist in the final product may be in either direction.

In a preferred embodiment of the invention, one or more ends of 20–70 denier, multifilament stretch nylon (Helanca or false-twist type) and a 70–140 denier, essentially twist-free multifilament polyurethane yarn (e.g. Lycra yarn) are twisted together 5–10 turns per inch while the polyurethane yarn is elongated from 150–400 percent and the stretch nylon is extended from 10 to 300 percent from the relaxed state. Desirably, the resulting product comprises from 25 to 85% by weight of nylon and 5 to 65% by weight of polyurethane yarn.

Figure 2:
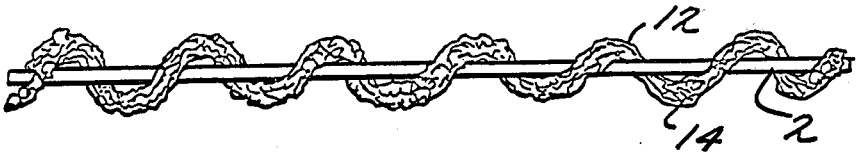

The invention is further described with reference to the accompanying drawings wherein:

FIG. 1 is a schematic view of apparatus suitable for use in preparing the composite yarn of the invention; and FIG. 2 is a schematic view of the composite yarn of the invention in a partially stretched condition.

Referring more specifically to the drawings, the elastomer yarn 2 e.g. 70 denier multifilament Lycra yarn, is taken from creel 4 and passed through an appropriate guide 6 to the top feed roll 8 of a conventional two roll ring twister. Advantageously, the yarn is drawn off the creel end over end to give better delivery tension. Additionally, in order to insure even elongation, it is important that the elastomer yarn be in the relaxed state before reaching feed roll 8 and to insure proper control, the yarn should be wrapped around roll 8 several times after which the yarn is passed to the bottom feed roll 10.

The top roll 8 is geared to operate at a fixed speed with respect to the bottom roll and this relationship should be such as to permit a bottom roll surface speed sufficiently greater than the surface speed of the top roll to give the desired yarn elongation. For example, the surface speed of the bottom roll may be from about one-half to five times greater than the surface speed of the top roll.

In the embodiment illustrated, two ends 12 and 14 of textured yarn (e.g. 70 denier, 34 filament stretch nylon yarn) are passed from suitable creels 16 and 18 or the like directly to the bottom feed roll 10 where the ends are wound around the roll several times to facilitate control. Advantageously, these ends are creeled so that they run on the same spindle position.

From the bottom roll, the elongated (e.g. 50–400 percent) elastomer yarn 2 and the ends of textured yarn 12 and 14 pass together through guide 20 and then through the traveller 22 of a ring 24 to a bobbin 26 on spindle 28. The speed of the bottom roll 10 and spindle 28 determine the turns per inch of twist applied by the ring twister. Thus, for example, at a spindle speed of 6M RPM and a surface speed of 70 yards per minute for the bottom feed roll, the twist in the finished product as wound on the spindle amounts to 2.5 turns per linear inch.

As a typical illustration, it may be mentioned that a highly desirable product is obtained by twisting together with 10 turns S, a 70 denier Lycra polyurethane yarn stretched 150 percent and two ends of 70/34 stretch nylon with Z torque therein. The resulting product has a total denier of 178 when extended and comprises 82% nylon and 18% Lycra (or 146 denier nylon and 32 denier Lycra).

Other typical examples of composite yarns prepared according to the present invention are the following:

140 denier polyurethane thread elongated 405 percent and twisted 5 turns S direction with one end of 70/34 stretch nylon S torque and one end of 70/34 stretch nylon Z torque.

70 denier polyurethane thread elongated 150 percent and twisted 10 turns S direction with one end of 70/34 stretch nylon Z torque.

140 denier polyurethane thread elongated 380 percent and twisted 10 turns S direction with one end of 70/34 stretch nylon Z torque.

70 denier polyurethane thread elongated 200% and twisted 10 turns S direction with two ends 20/7 stretch nylon Z torque.

The composite product of the invention is shown in the partially elongated condition in FIG. 2. As illustrated, the stretch nylon ends 12 and 14 relatively loosely wind around the Lycra yarn 2 when the latter is partially extended but, upon complete relaxation, the stretch nylon substantially completely covers the polyurethane yarn to give a product demonstrating exceptionally good bulk and muscle useful in a variety of different types of knitted and woven goods, e.g. sock tops; support hose, surgical or otherwise; tricot; swimwear; etc.

It will be appreciated that various modifications may be made in the invention described herein. Hence, the scope of the invention is set forth in the following claims wherein:

What is claimed is:

1. A method for producing a composite elastic yarn which comprises the steps of:

a. providing at least one bulked thermoplastic yarn on a package, b. unwinding said yarn from said package so as to remove the added bulk of the yarn, c. feeding said yarn to a rotatable roll, d. providing an elastic filament on a package, e. feeding said elastic filament to engage said roll, the ratio of the surface speed of said roll to the feed of the elastic filament to said roll being variable to cause the elastic filament to be stretched a predetermined amount between the package and the roll, f. feeding said filament and at least one yarn to a take-up package and imparting plying twist to said filament and yarn to form a composite yarn, and g. thereafter allowing said composite yarn to relax so as to permit the elastic filament to contract and the thermoplastic yarn to return to a bulked condition.

2. The method of claim 1 wherein the bulked thermoplastic yarn is composed of filaments selected from the group consisting of nylon and polyester.

3. The method of claim 1 wherein the bulked thermoplastic yarn is a bulked continuous multifilament nylon yarn.

4. The method of claim 1 wherein the elastic filament is a polyurethane filament.

5. The method of claim 1 wherein the ratio of the surface speed of the roll to the feed of the elastic filament thereto is from 1.5:1 to 5.0:1.

6. The method of claim 1 wherein the elastic filament is stretched from 50 to 400 percent.

7. The method of claim 1 wherein there is imparted from about 2 to 20 turns per inch of plying twist.

8. A composite elastic yarn produced by the method of claim 1.

9. A fabric made from the yarn of claim 8.

* * * * *